US010273626B2

(12) United States Patent
Spitz et al.

(10) Patent No.: US 10,273,626 B2
(45) Date of Patent: Apr. 30, 2019

(54) PORTABLE, COLLAPSIBLE CLOTHES DRYER

(71) Applicants: Robert K. Spitz, Amherst, NH (US); John Spitz, Merrimack, NH (US); Beth K. Wallach, White Plains, NY (US); Brian Wallach, White Plains, NY (US)

(72) Inventors: Robert K. Spitz, Amherst, NH (US); John Spitz, Merrimack, NH (US); Beth K. Wallach, White Plains, NY (US); Brian Wallach, White Plains, NY (US)

( * ) Notice: Subject to any disclaimer, the term of this patent is extended or adjusted under 35 U.S.C. 154(b) by 439 days.

(21) Appl. No.: 15/161,609

(22) Filed: May 23, 2016

(65) Prior Publication Data

US 2016/0348301 A1 Dec. 1, 2016

Related U.S. Application Data

(60) Provisional application No. 62/169,037, filed on Jun. 1, 2015.

(51) Int. Cl.
*D06F 58/20* (2006.01)
*D06F 58/14* (2006.01)

(52) U.S. Cl.
CPC ..... *D06F 58/20* (2013.01); *D06F 58/14* (2013.01)

(58) Field of Classification Search
CPC ..... D06F 58/20; D06F 58/14
See application file for complete search history.

(56) References Cited

U.S. PATENT DOCUMENTS 3,264,755 A * 8/1966 Moore ..... D06F 58/14 206/216
3,576,079 A * 4/1971 Hauser ..... D06F 73/02 34/239
3,577,650 A 5/1971 Brahm
4,195,416 A * 4/1980 Hall ..... A47K 10/48 34/233
5,388,344 A 2/1995 Wallach
6,612,453 B2 * 9/2003 Joo-Tai ..... A45C 7/0077 220/9.2

(Continued)

FOREIGN PATENT DOCUMENTS

GB 2247514 A 3/1992
WO 2013011498 A2 1/2013

*Primary Examiner* — Jessica Yuen
(74) *Attorney, Agent, or Firm* — Robert W. Morris; Ojeiku C. Aisiku; Eckert Seamans Cherin & Mellott, LLC

(57) ABSTRACT

A portable, collapsible clothes dryer, for use in drying small articles of clothing while traveling and/or for use in households with limited space, is composed of a cylindrical collapsible central housing with an inlet opening at the bottom, an airflow adapter at the inlet to attach a portable hair dryer, a spin-able clothes hanger, and a removable top member with air exhaust vents. When collapsed, the assembly assumes a compact, flat disk shape. When expanded, the portable hair dryer can blow hot air into the housing, forming a vortex stream within the cylindrical enclosure that exits through the exhaust vents in the top. The top member can be removed to attach articles of clothing to the spin-able clothes hanger. The unit is designed such that the vortex air stream that flows upward within the cylindrical enclosure and out the upper exhaust vents spins the clothes hanger with the articles of clothing, thereby ensuring complete coverage of the hot air over the clothing surfaces and speeding the drying time.

20 Claims, 11 Drawing Sheets

(56) References Cited

U.S. PATENT DOCUMENTS

| | | | | |
|---|---|---|---|---|
| 7,762,006 | B2 * | 7/2010 | Kasso | F26B 9/003 34/202 |
| 8,813,385 | B2 | 8/2014 | Blum | |
| 2008/0184950 | A1 | 8/2008 | Lozano | |
| 2014/0190033 | A1 * | 7/2014 | Provenzano | F26B 25/08 34/202 |

* cited by examiner

PORTABLE, COLLAPSIBLE CLOTHES DRYER

CROSS-REFERENCE TO RELATED APPLICATION

This patent application claims priority from the U.S. Provisional Application No. 62/169,037 filed Jun. 1, 2015, and entitled "COLLAPSIBLE PORTABLE CLOTHES DRYER."

BACKGROUND OF THE INVENTION

When people travel they often have a need to quickly dry small articles of clothing such as swimsuits, socks, ladies stockings, underwear or other lingerie. While it is possible to quickly wash such items of clothing in a hotel sink, the clothes can take many hours or even a day to fully dry. To reduce drying time, travelers often hang the items on a lamp or drape them over a lampshade, which may stain or otherwise cause damage to hotel property.

College students living in a dormitory room also have a need to quickly wash and dry certain articles of clothing. Students in dorms have very limited space and often no nearby laundry facilities. Frequently they discover they are out of a clean blouse, shirt, socks, undergarments, etc. While they have access to a sink to quickly wash the garment(s), the associated drying time can take many hours.

SUMMARY OF THE INVENTION

A principal object of the present invention, therefore, is to provide a portable and collapsible clothes dryer which addresses the needs described above for travelling businesspersons, tourists, college students and others who have limited space, to quickly dry a few light items of clothing such as lingerie, blouses, socks, handkerchiefs, T-shirts, undershorts and the like.

A further, more particular object of the present invention is to provide a portable, collapsible clothes dryer which can fold flat and easily fit in a suitcase when travelling and, for dorm rooms or apartments with limited space, can compactly fit inside a closet or on a small shelf.

A still further object of the present invention is to provide a clothes dryer which uses a portable hair dryer, a common travel accessary that is available in many hotel rooms, as a source of hot air for drying small items of clothing.

General object of the present invention, finally, is to provide a portable collapsible clothes dryer that can be easily stored, taking up minimal space, and that can quickly expand into its use configuration and efficiently dry small articles of clothing in less than one hour when powered by a portable hair dryer.

These objects, as well as other objects which will become apparent from the discussion that follows, are achieved, according to the present invention, by providing a portable collapsible clothes dryer comprising two main elements:

(1) A collapsible dryer housing having an inlet opening for the ingress of air from the hot air outlet nozzle of the hair dryer and at least one outlet opening for the egress of air. The dryer housing includes a top member and at least one side member forming an upstanding enclosure surrounding a central vertical axis when in its operable configuration. The housing enclosure is designed to be collapsible from top to bottom to reduce its size when in its storage configuration. At least one of the housing members, preferably the top member, is removable for insertion and removal of items of clothing. The housing includes an air inlet opening near one end, preferably the bottom, and at least one air outlet opening near an opposite end, preferably the top, when the housing is in the operable configuration. The inlet opening is oriented to direct hot air from the hair dryer substantially horizontally and to one side of the central vertical axis to thereby create a vortex flow of air within the housing enclosure.

(2) A clothes holder which is configured to be mounted within the housing adjacent to the top when the housing is in its operable configuration. The holder, which is conveniently removable from the housing, has at least one clip for attachment of one or more clothing items, thereby to hang the clothing item(s) inside the housing enclosure.

Rather than tumble the clothing horizontally, the clothes dryer therefore spins the clothing about the vertical axis in the vortex stream of hot air. The airflow is powered by the hair dryer, the air outlet of which is inserted into the inlet opening of the housing.

If the inlet opening is at the bottom of the enclosure, the hair dryer can lie securely on the floor or countertop, requiring no additional suspension.

When wet, items of clothing can have substantial weight. It can take considerable force to efficiently tumble wet clothes in a horizontal cylinder. The force provided by the airflow of a typical hair dryer is therefore insufficient to effectively tumble and dry wet clothes in a horizontal drum. This orientation would require a more powerful independent motor to power the drum, adding significant size, cost and weight to the dryer.

By suspending the clothes in a housing and blowing a vortex of spinning hot air around suspended clothes, the stream of hot air will both spin and dry the clothes. The spinning action of the clothes within the stream of air thus exposes a significant portion of the surface area of the clothes to the air stream. This promotes efficient drying of the entire garment, eliminating damp spots and reducing drying time.

Preferably the housing is cylindrical in shape, promoting the vortex flow and retaining the moving air in close proximity to the clothing.

Despite the added weight from moisture in the clothing, the hanging clothes can nevertheless be slowly spun and dried by the spinning vortex airflow from the hair dryer. This spinning operation is ensured by suspending the clothes hanger on a swivel bearing with a low coefficient of friction. The clothes attached to the hanger are easily induced to spin in the vortex of hot air flowing within the interior of the clothes dryer housing.

Preferably the collapsible dryer housing is constructed of heat and fire retardant flexible material, such as fabric. It expands to create an enclosure, preferably cylindrical in shape, to hold the clothing and also to contain and direct the hot airflow from the hair dryer. The interior of the housing wall(s) contain a metallic wire, which acts as a spring to expand the housing to, and maintain it at, its full, useful size. It uses straps or buckles to hold it in a collapsed state for transport or storage. The collapsible housing can be manufactured from temperature resistant cloth, nylon, or similar materials. The housing has an adjustable air flow connector to secure the blower end of a hair dryer. Adapters can be provided to match various sizes of different hairdryers. There may be a wide variety of clothes dryer sizes based on clothing size needs and as well available suitcase or storage space.

A top assembly of the housing which comprises a removable top plate, that holds a spin-able clothing holder, such as one or more clothes hangers. The clothes hanger can swivel and allow the clothing to spin in the hot air flow. The top plate may be secured to the housing with straps, a zipper, or other means. The top plate can either be constructed of light-weight plastic or a reinforced fabric. The top assembly includes a low-friction swivel bearing to attach the clothes hanger, allowing it to spin about the vertical axis.

The top plate preferably has a series of air vent slots, which allow the rising hot air to exit as well as induce a spinning vortex of air within the interior wall surfaces of the housing. The air vent slots radiate outward from a center point to the edges of the top plate in such a way to promote this spinning vortex of airflow. The ratio of the total area of the exhaust vents must properly correspond with the hair-dryer input adapter hole size to allow a sufficient level of ambient heat to develop within the interior of the cylinder as well as allowing for an adequate airstream to develop into a spinning vortex.

The top assembly may have enhanced methods of causing the clothing to spin, for example:

a) An advantageous implementation is to attach simple circular, preferably compressible, fan attached to the bottom of the top plate. When the housing is expanded, the fan blades are exposed. The fan blades are fashioned to catch the rising hot air flow and further promote a spinning motion of the clothing being dried.

b) An alternative top assembly implementation is to use a small electric motor (either battery or line voltage) connected to a shaft which directly rotates the clothes hanger within the spinning vortex of airflow within the housing.

There are several possible types of clothes hangers that can be used for the present invention. The first is a single hanger with clips to hold a single article of clothing. Alternatively, a multi-tiered hanger can be used to allow several smaller articles, such as several pairs of socks or ladies stockings, to be dried at the same time.

In addition to the base unit, several optional components may be added.

A count down timer, into which to the hair dryer power cord is plugged, that automatically shuts off the dryer after a pre-determined period of time.

A safety temperature sensor to detect excessive air temperature within the housing and emit an alarm signal, or to activate a shutoff switch to disconnect power from the attached hair dryer.

Preferred embodiments of the portable, collapsible clothes dryer will be understood from the following drawings.

DESCRIPTION OF THE PREFERRED EMBODIMENTS

Figure 1:
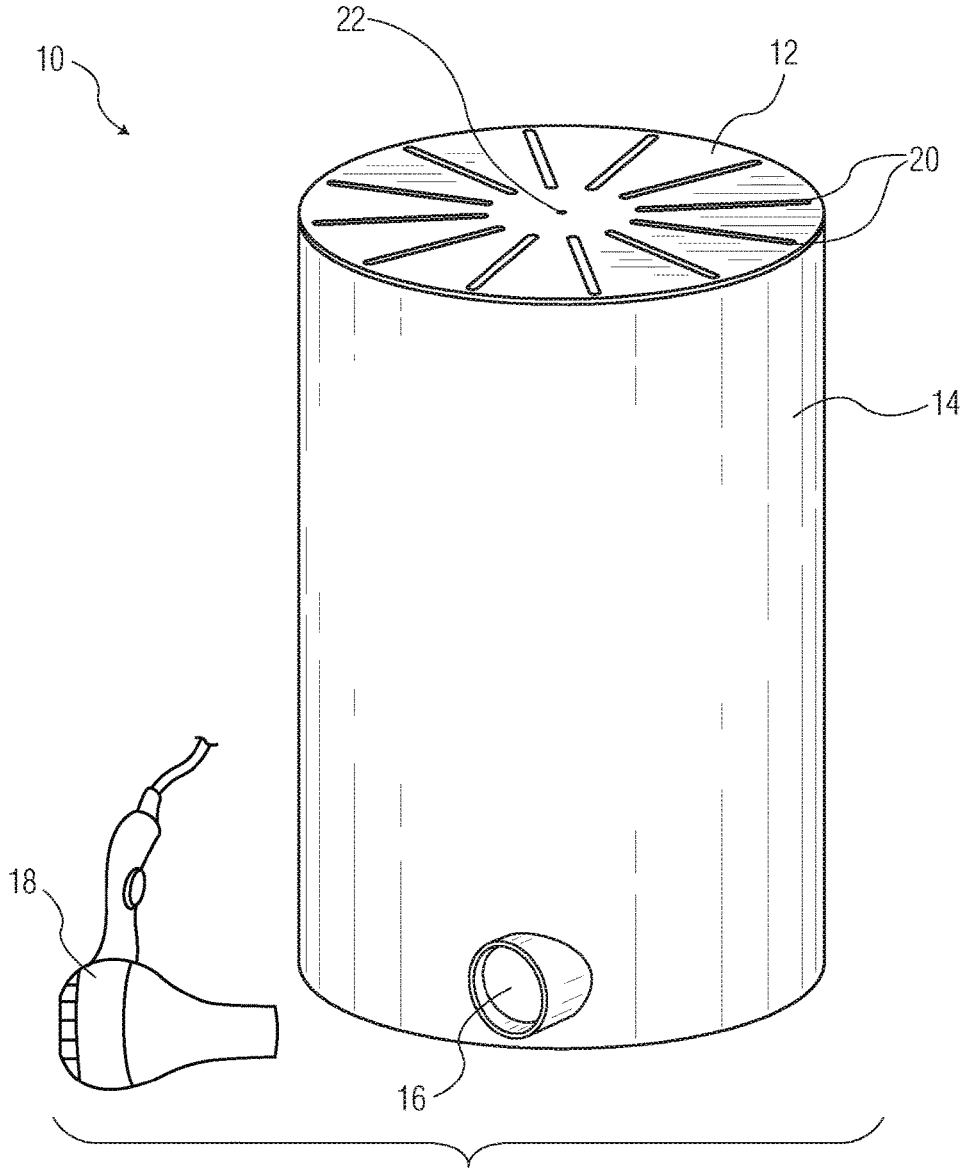
FIG. 1 is a perspective view of the portable, collapsible clothes dryer according to the present invention, shown in its fully expanded, operable configuration.

The preferred embodiments of the present invention will now be described with referenced to FIGS. 1-10 of the drawings. Identical elements shown in the various figures are designated with the same reference numerals.

FIG. 1 shows the portable and collapsible clothes dryer according to the invention in perspective view. The dryer 10 in this embodiment has a housing, comprising a circular top member 12 and a cylindrical side member 14, that forms an enclosure. Near the bottom of the enclosure is an inlet opening 16 in the side member 14 for receiving hot air from a portable hair dryer accessory 18. The top member 12 is provided with a plurality of outlet openings, in the form of slots 20, that extend radially outward about the center point 22 thereof. The number and/or the size of these slots 20 are preferably adjustable, for example by means of a rotatable disc (not shown) on the upper surface of the top member 12 and pivoted about at the center point 22, having vent openings for respectively opening and closing portions of the slots.

Figure 2:
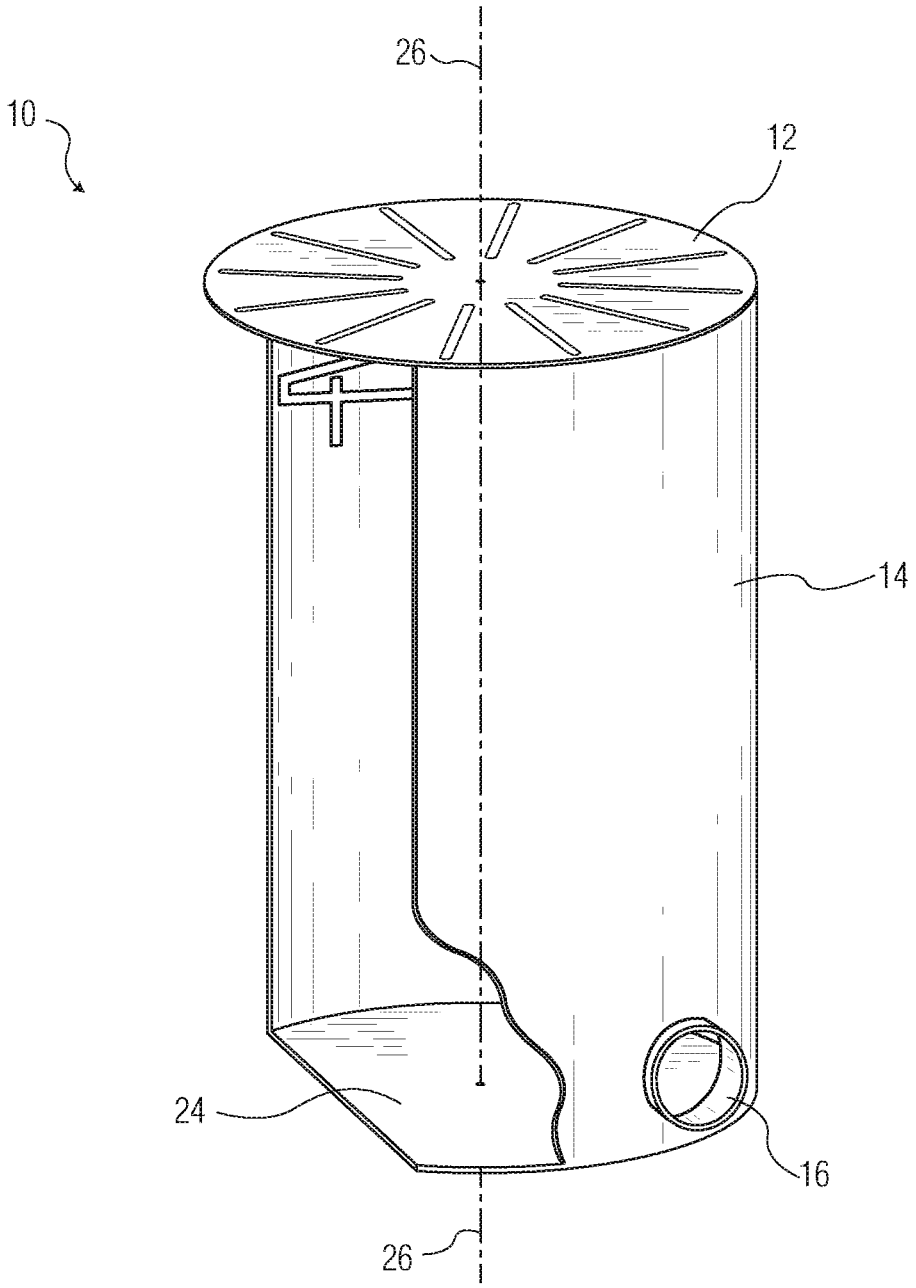
FIG. 2 is a cut-away view of the clothes dryer of FIG. 1 showing the top plate installed with a single clothes hanger attached.

FIG. 2 shows the clothes dryer 10 in cut-away view. As may be seen in this figure, the housing includes a circular bottom member 24 that supports the side member 14. The enclosure, so formed, defines a central vertical axis 26-26, as shown in dashed lines.

Figure 3:
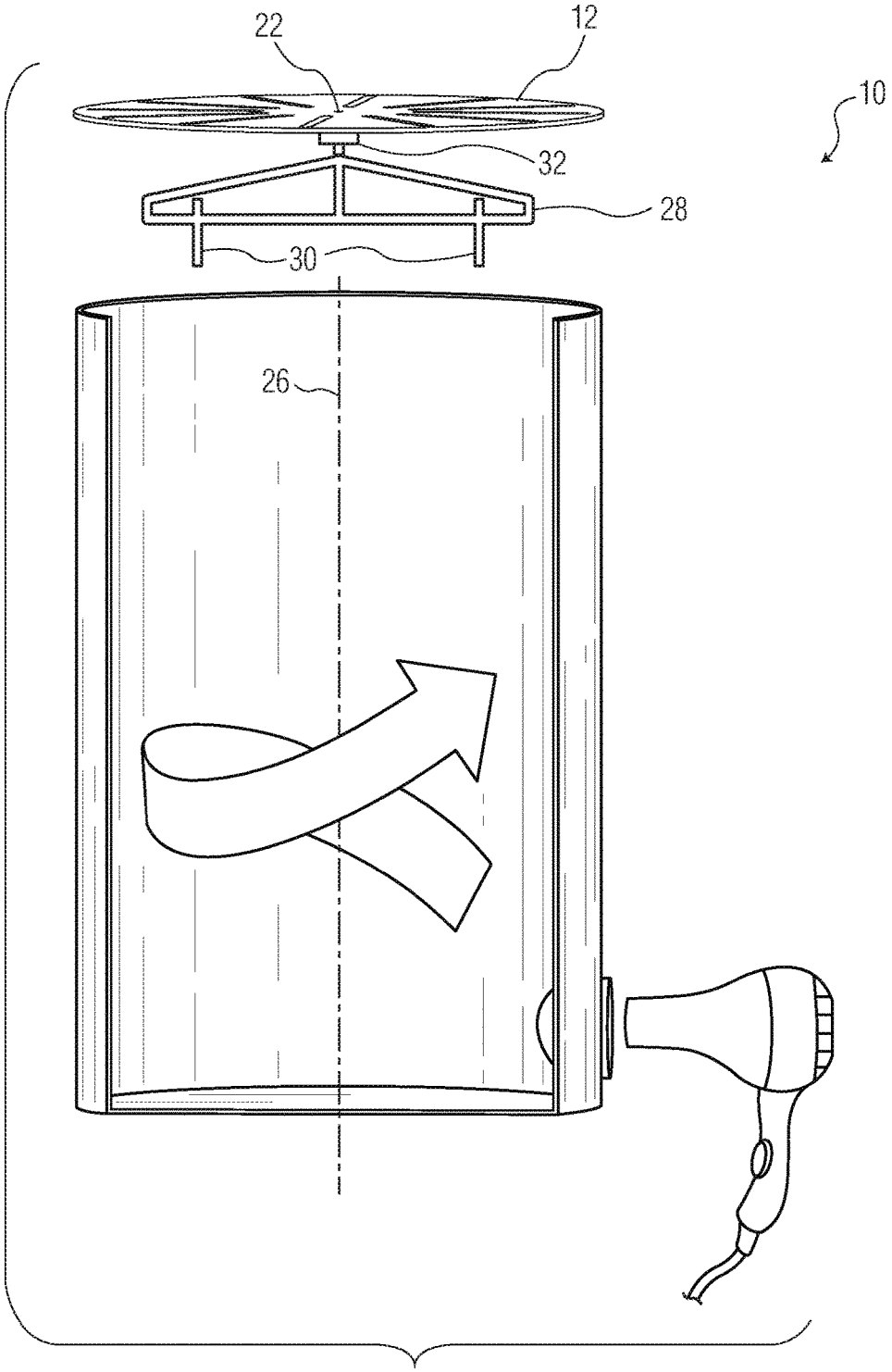
FIG. 3 is a cut-away view of the clothes dryer of FIG. 1 with the top plate removed and with a single clothes hanger attached thereto by means of a low-friction bearing, thereby to allow clothes to rotate within the cylindrical enclosure due to the vortex airflow produced by an attached hair dryer.

The inlet opening 16 is oriented such that hot air introduced into the enclosure by the hair dryer is directed substantially horizontally to one side of the central vertical axis, thereby to create a vortex flow of air around this axis, as illustrated by the arrow in FIG. 3.

FIG. 3 shows the clothes dryer 10 with the top member 12 removed. Beneath the top member is suspended a clothes holder element 28, having clips 30 for hanging one or more small articles of clothing: lingerie, blouses, socks, handkerchiefs, T-shirts, undershorts and the like. The clothes holder is suspended at the center point 22 by means of a low-friction bearing 32 that allows its rotation with the vortex of air. To facilitate transport and storage, the clothes holder is removable from the top member and/or the bearing 32.

Figure 4:
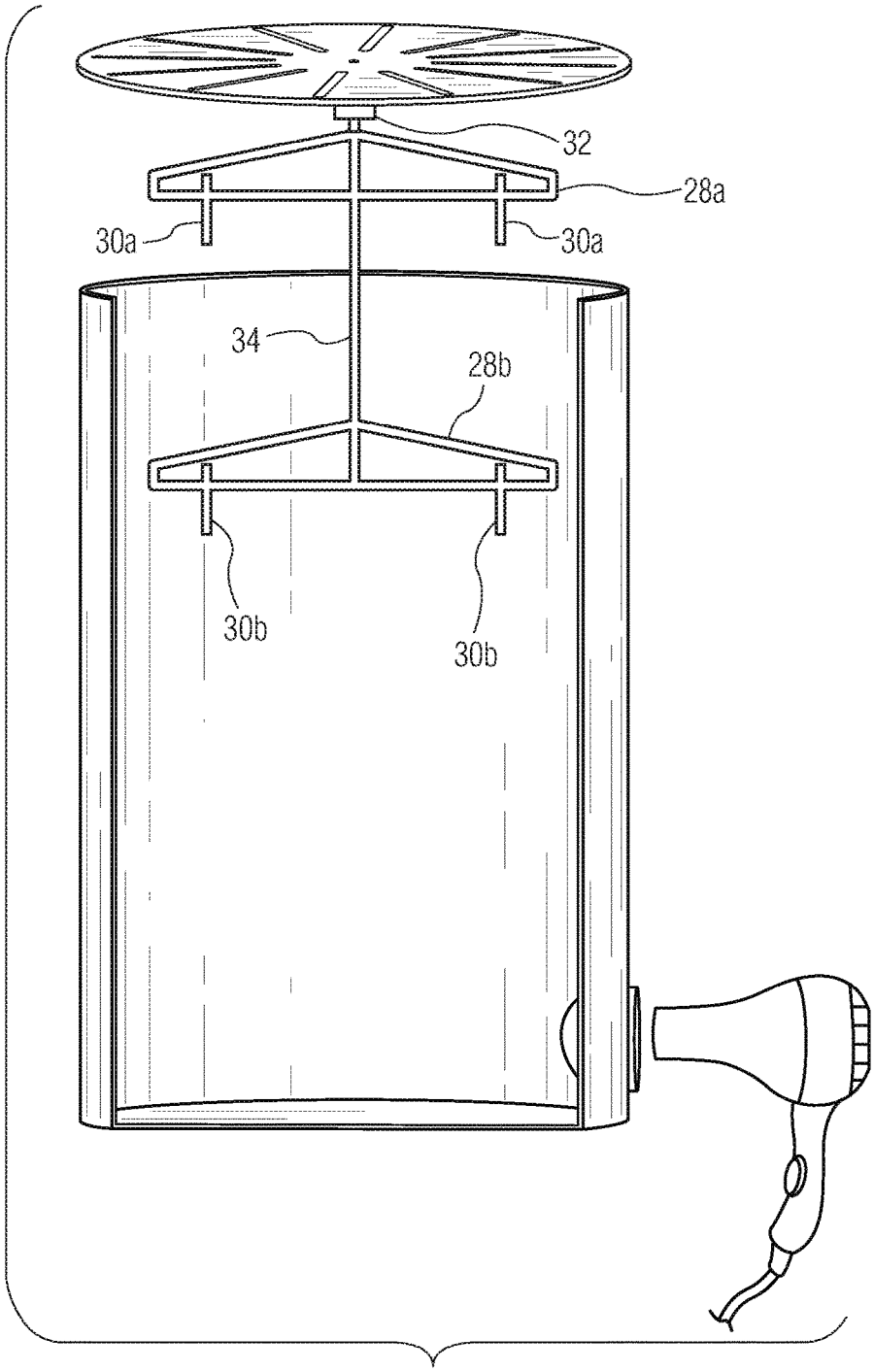
FIG. 4 is a cut-away view of the clothes dryer of FIG. 1 with the top plate removed and with a double clothes hanger attached for holding multiple articles of clothing.

FIG. 4 shows a similar configuration to that of FIG. 3, except that the clothes holder 28 is formed with two levels—an upper level 28*a* and lower level 28*b*—connected by a common central support member 34. Each level includes clothing clips, 30*a* and 30*b* respectively, for hanging clothes.

Figure 5:
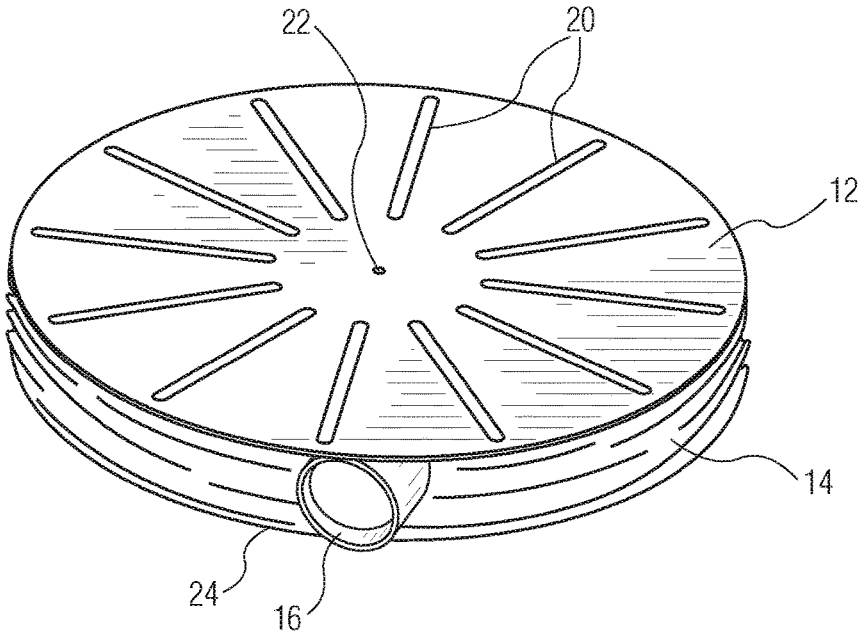
FIG. 5 is a perspective view of the clothes dryer of FIG. 1 in collapsed state, suitable for storage.

The side member 14 of the housing enclosure is preferably made of a fire-retardant textile fabric, allowing the enclosure to be collapsed for storage or transport, as shown in FIG. 5. When erected, the side member is held upright by a metal spring, as explained below in connection with FIG. 10.

Figure 6:
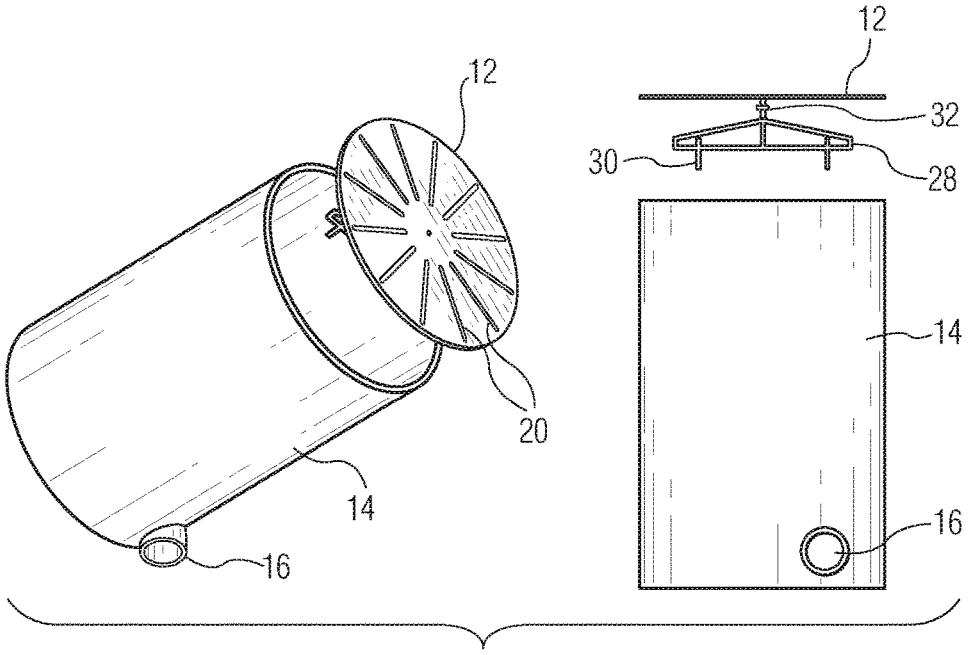
FIG. 6 is a perspective view of the clothes dryer of FIG. 1 showing the relationship of the major components.

FIG. 6 is an assembly diagram showing the main components of the portable, collapsible clothes dryer: the side member 14 with the inlet opening 16, the top member 12 with the outlet openings (slots) 20, and the clothes holder 28 with the clips 30 for hanging clothes.

Figure 7:
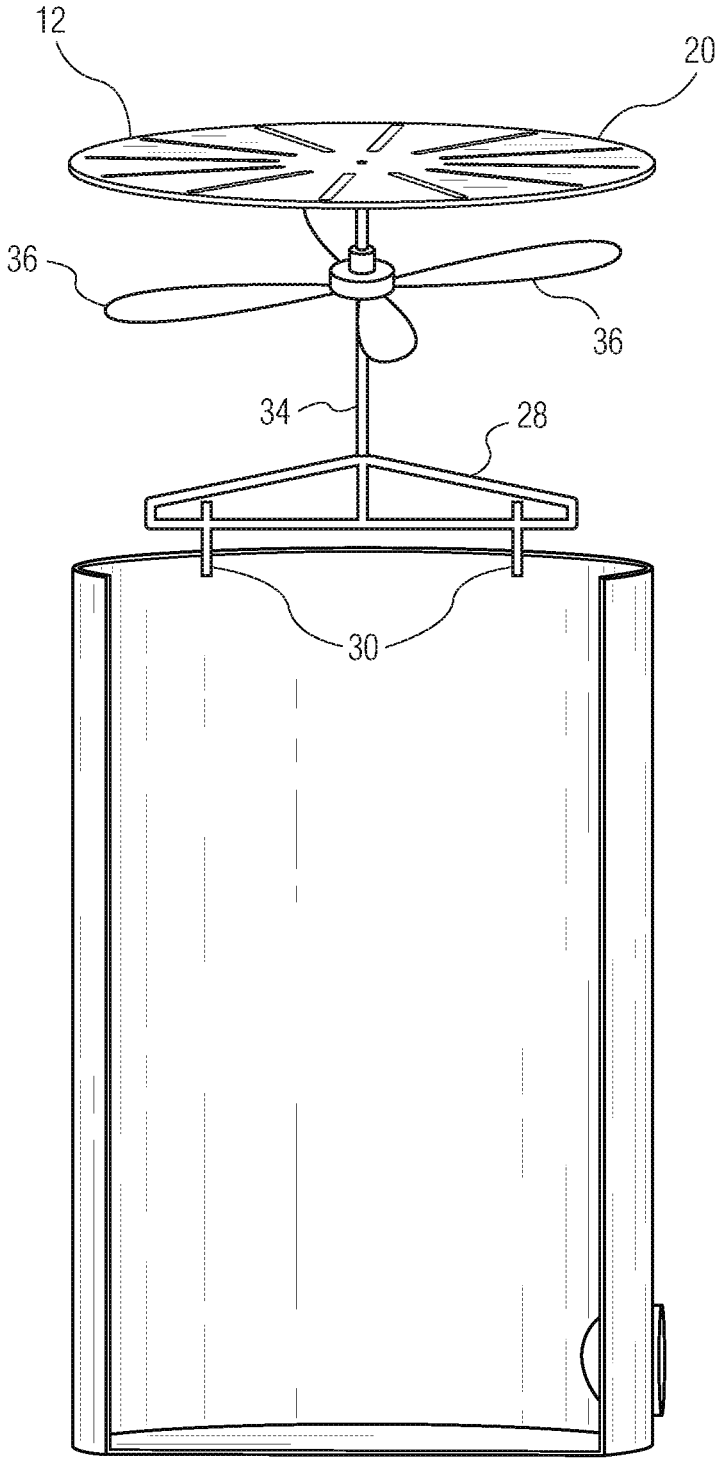
FIG. 7 is a cut-away view of the clothes dryer of FIG. 1 showing details of an embodiment having fan blades for assisting in rotating the clothes hanger.
Figure 8:
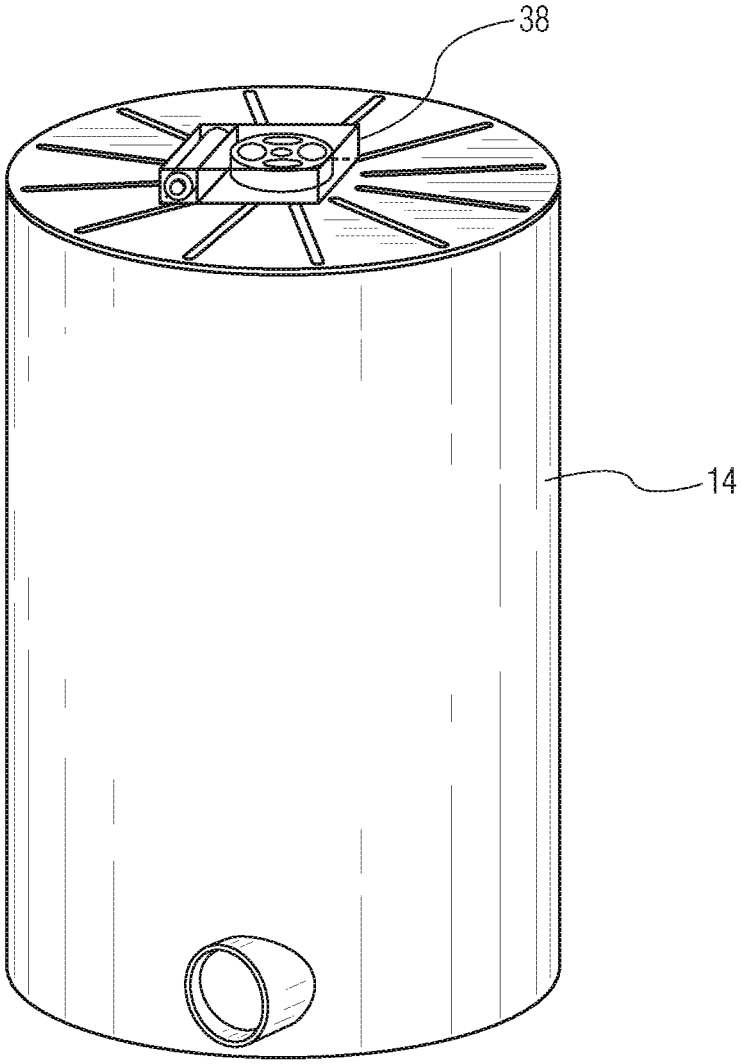
FIG. 8 is a cut-away view of the clothes dryer of FIG. 1 showing details of an embodiment with a battery-powered motor for rotating the clothes hanger.
Figure 9:
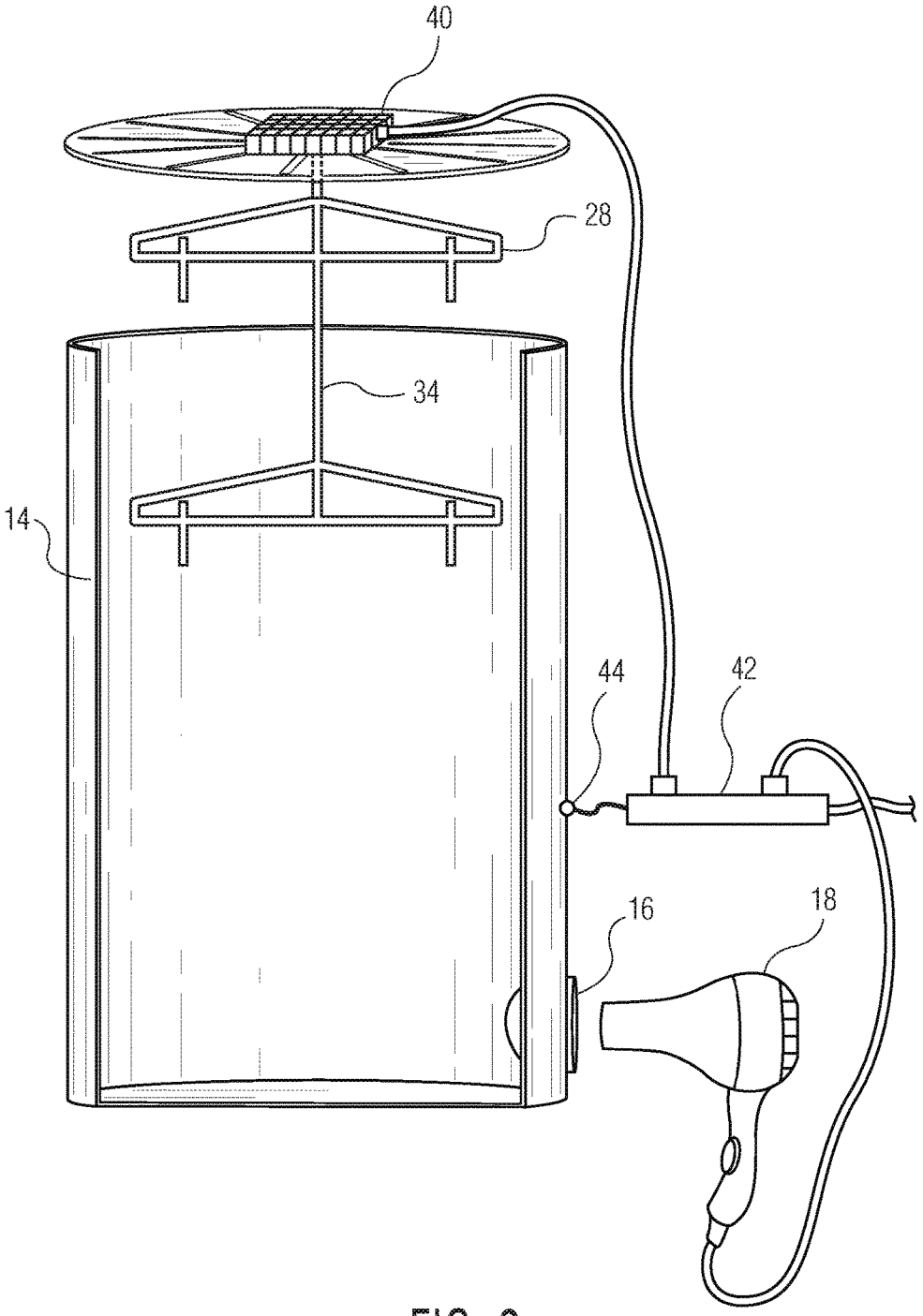
FIG. 9 is a cut-away view of the clothes dryer of FIG. 1 showing details of an embodiment with a mains-powered motor for rotating the clothes hanger.

FIGS. 7, 8 and 9 illustrate three different embodiments that provide a force for rotation of the clothes holder. In FIG. 7 fan blades 36 have been added in the path of the vortex flow of air, just below the outlet openings 20 in the top member 12. In FIG. 8 a battery-powered D.C. motor 38 is connected to rotate the central support member 34 of the clothes holder; in FIG. 9 an electric motor 40 is powered by an electric wire plugged into a wall socket or to a power strip 42, associated with the clothes dryer, that is also used to power the hair dryer 18.

According to an advantageous feature of the invention, the power strip is responsive to a temperature sensor 44 that switches off the power to the hair dryer when the temperature of the enclosure exceeds a safe level. The power strip can also include a timer to automatically switch off the hair dryer after a predetermined time.

Figure 10:
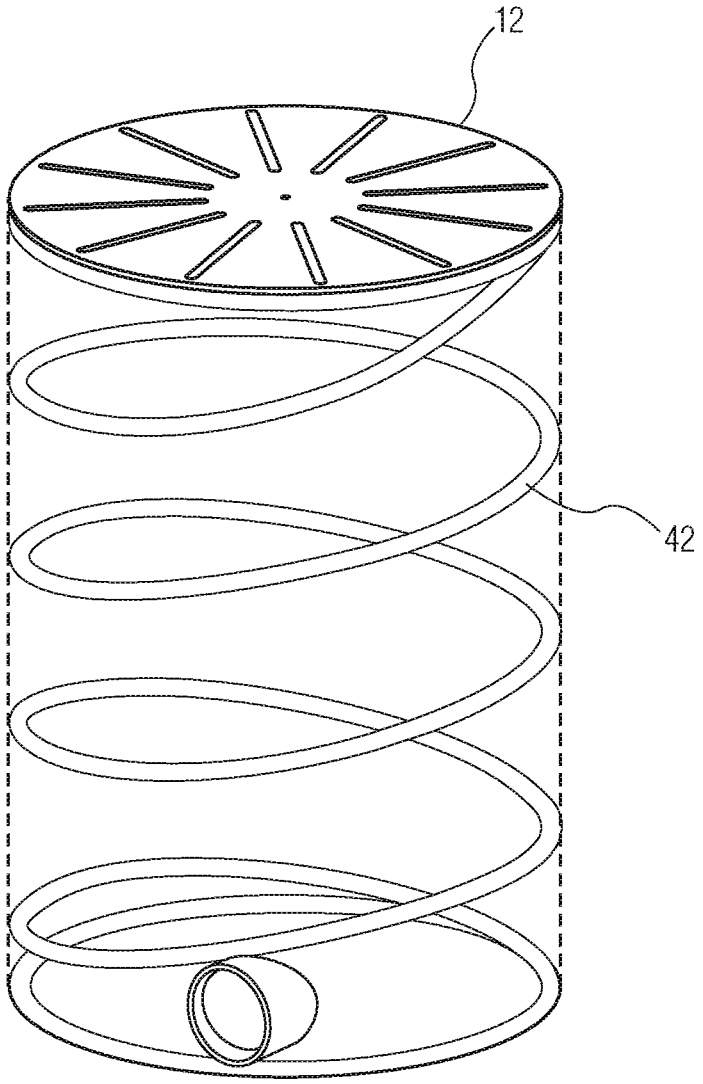
FIG. 10 is a phantom view of the clothes dryer of FIG. 1 showing a large coil spring for holding the dryer enclosure open when in the operable configuration and allowing the enclosure to collapse for transport and storage.

FIG. 10 illustrates how the housing enclosure of the clothes dryer according to the invention can be expanded and held in its operable configuration when in use. A coil spring 42 (shown not to scale) with a diameter matching the width of the enclosure biases apart the top and bottom to the fullest extent permitted by the side member(s). The enclosure is also collapsible to the storage configuration shown in FIG. 5.

Figure 11:
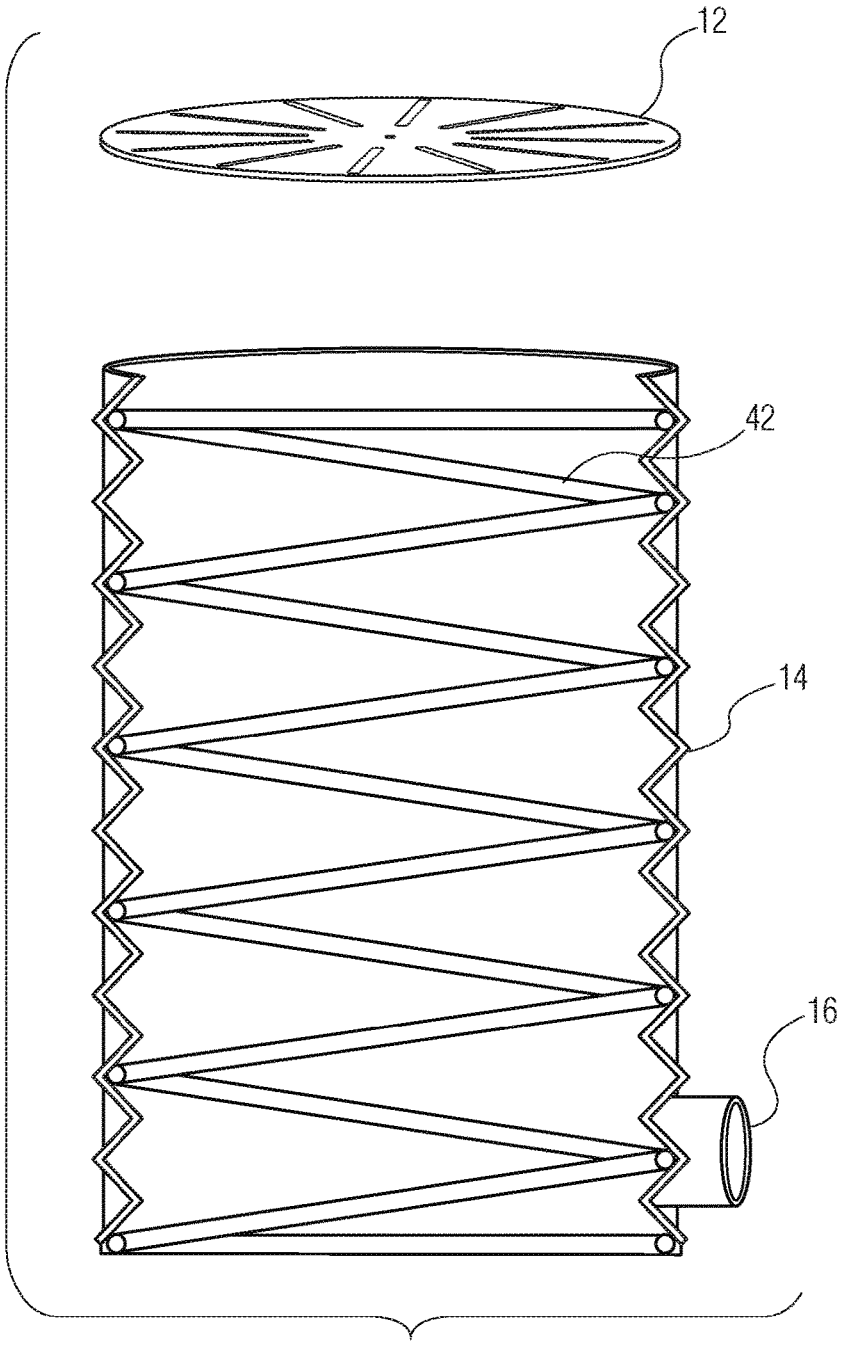
FIG. 11 is a cut-away view of the clothes dryer of FIG. 1 showing details of an embodiment with bellows forming the side wall members of the housing enclosure.

FIG. 11 shows an alternative embodiment of the enclosure for the clothes dryer according to the present invention. In this embodiment the side member 14 is designed as a "bellows" so that the flexible material forming the side member 14 collapses evenly when the enclosure is compressed for travelling and/or storage. The coil spring 42 fits neatly between the folds of the bellows.

Figure 12:
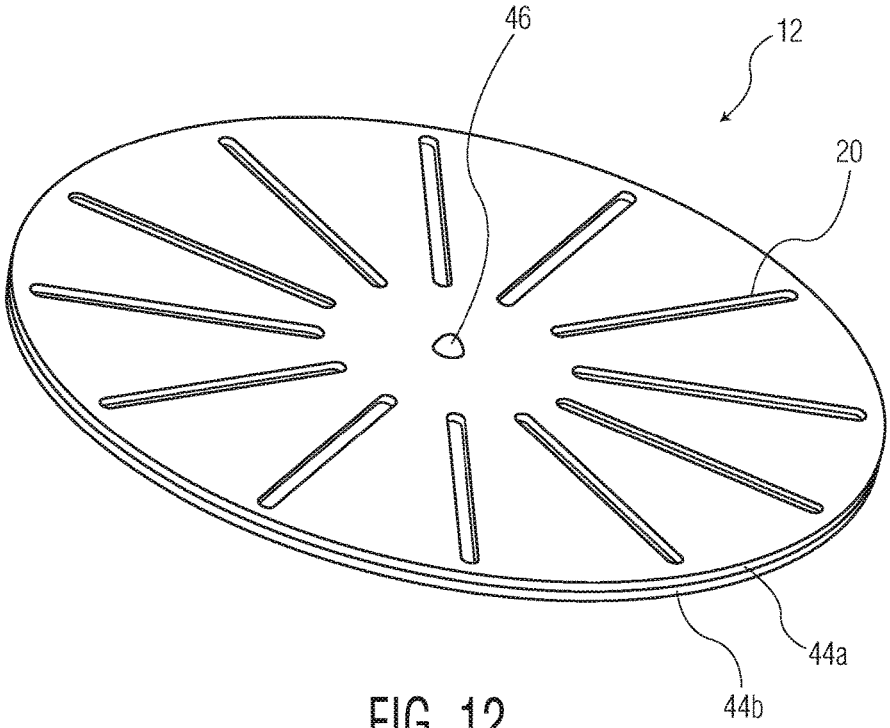
FIG. 12 is a detailed view of the top member of the housing, showing the relationship of two discs that rotate relative to each other to vary the size of the vent openings.

FIG. 12 is a detailed view of the top member 12. In this preferred embodiment the top member is comprised of two discs, an upper disc 44*a* and a lower disc 44*b*. The upper disc is rotatably connected to the lower disc by means of a center rivet 46. By rotating the upper disc 44*a*, the user is able to vary the size of the vent openings 20, thereby regulating the airflow within the enclosure and adjusting the temperature.

There has thus been shown and described a novel portable and collapsible clothes dryer which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A portable and collapsible clothes dryer adapted to operate in combination with a conventional hair dryer having a heating element, an air blower for passing air across said heating element and a hot air outlet nozzle, said clothes dryer comprising, in combination:

(a) a collapsible dryer housing having an inlet opening for the ingress of air from the hot air outlet nozzle of the hair dryer and at least one outlet opening for the egress of air, said dryer housing comprising a top member and at least one side member forming an upstanding enclosure w with a top, a bottom and a central vertical axis when in an operable configuration, said housing enclosure being collapsible from top to bottom to reduce its size when in a storage configuration, at least one of said housing members being openable for insertion and removal of items of clothing into and from the enclosure; and (b) a clothes holder, configured to be removably mounted within the housing adjacent the top thereof when the housing is in the operable configuration, and having at least one clip for attaching a clothing item thereto, said holder being thereby adapted to hang at least one clothing item inside the housing, wherein the clothes holder is configured to rotate about the central vertical axis when the housing is in the operable configuration, and wherein the clothes holder is supported from the top member by means of a bearing which allows for rotation thereof about the central vertical axis with respect to the top member;

wherein said inlet opening of said housing is disposed adjacent one end and the at least one outlet opening disposed adjacent an opposite end thereof when the housing is in the operable configuration, and wherein said inlet opening is oriented to direct hot air from the hair dryer substantially horizontally and to one side of the central vertical axis to thereby create a vortex flow of air around said axis within the housing enclosure.

2. The clothes dryer defined in claim 1, wherein the inlet opening is adjacent the bottom and the at least one outlet opening is adjacent the top of the housing enclosure.

3. The clothes dryer defined in claim 1, wherein the housing enclosure is cylindrical in shape when in the operable configuration.

4. The clothes dryer defined in claim 1, wherein the housing further comprises at least one spring member arranged to maintain separation between the top and the bottom of the housing enclosure when the enclosure is in the operable configuration.

5. The clothes dryer defined in claim. 1, wherein the side members of the housing are made of a flexible material.

6. The clothes dryer defined in claim 5, wherein the side members of the housing are made of a textile fabric.

7. The clothes dryer defined in claim 1, wherein the side members of the housing form a bellows which is collapsible from the operable configuration to the storage configuration.

8. The clothes dryer defined in claim 1, wherein the housing further comprises a bottom member, attached to the at least one side member.

9. The clothes dryer defined in claim 1, wherein the top member is removable from the housing enclosure, to allow insertion and removal of the clothes holder.

10. The clothes dryer defined in claim 9, wherein the clothes holder is attachable to the top member.

11. The clothes dryer defined in claim 1, wherein at least one outlet opening is disposed in the top member.

12. The clothes dryer defined in claim 11, wherein the outlet opening includes a plurality of slots in the top member.

13. The clothes dryer defined in claim 12, wherein the slots extend radially outward from a central point in the top member.

14. The clothes dryer defined in claim 1, further comprising an electrical outlet for connecting the hair dryer and an electric switch for turning electric power to the hair dryer on and off.

15. The clothes dryer defined in claim 14, wherein the electric switch is operative to automatically turn off power to the hair dryer after a predetermined period of time.

16. The clothes dryer defined in claim 15, further comprising a temperature sensor attached to the housing enclosure and connected to the electric switch, said sensor being operative to measure the temperature inside the housing enclosure and to cause said switch to turn off power to the hair dryer when the measured temperature reaches a predetermined value.

17. The clothes dryer defined in claim 1, wherein the clothes holder includes a plurality of fan blades which cause it to rotate about the central vertical axis due to the flow of air through the housing enclosure.

18. The clothes dryer defined in claim 1, further comprising an electric motor, coupled to the clothes holder, which causes the clothes holder to rotate about the central vertical axis.

19. The clothes dryer defined in claim 1, further comprising a removable lint filter arranged on said housing adjacent the at least one outlet opening.

20. The clothes dryer defined in claim 1, further comprising manually adjustable means for varying the size of said at least one outlet opening.

* * * * *